US005190312A

United States Patent [19]

Baggio et al.

[11] Patent Number: 5,190,312

[45] Date of Patent: Mar. 2, 1993

[54] ANTIFRICTION DEVICE, PARTICULARLY FOR SKI BINDINGS

[75] Inventors: Giorgio Baggio, San Martino Di Lupari; Roberto Gorza, Feltre; Mirco Battistella, Breda Di Piave, all of Italy

[73] Assignee: Nordica S.p.A., Montebelluna, Italy

[21] Appl. No.: 753,469

[22] Filed: Sep. 3, 1991

[30] Foreign Application Priority Data

Sep. 10, 1990 [IT] Italy ..... 59380/90[U]

[51] Int. Cl.[5] ..... A63C 9/082; A63C 9/084

[52] U.S. Cl. ..... 280/628; 280/636

[58] Field of Search ..... 280/618, 626, 628, 633, 280/636, 624, 629, 617, 607

[56] References Cited

U.S. PATENT DOCUMENTS 4,858,946 8/1989 Stritzl et al. ..... 280/628
4,861,064 8/1989 Stritzl et al. ..... 280/618
4,892,326 1/1990 Svoboda et al. ..... 280/618

FOREIGN PATENT DOCUMENTS 8707516 12/1987 PCT Int'l Appl. .

*Primary Examiner*—Richard M. Camby
*Attorney, Agent, or Firm*—Guido Modiano; Albert Josif

[57] ABSTRACT

An antifriction device, particularly for ski bindings including a first body which is fixed to the ski or is associable therewith and with which a second body is slidingly associated with the possibility of sliding along an axis which is longitudinal to the ski. A tab is removably or permanently associable with the second body, and a plate is freely pivoted to the tab perpendicular to the ski and at the region underlying the heel and/or tip of a ski boot. Thus, upon the activation of the safety release of the binding, the tab performs a translatory and rotary motion which facilitates the disengagement of the boot from the binding.

3 Claims, 1 Drawing Sheet

ANTIFRICTION DEVICE, PARTICULARLY FOR SKI BINDINGS

BACKGROUND OF THE INVENTION

The present invention relates to an antifriction device particularly useable in ski bindings.

Antifriction devices used in ski bindings particularly at the tip elements of such bindings are currently known.

Some of these devices are simply constituted by a plate which is directly coupled to the ski and is made of antifriction material, for example of the type commercially know by the trade-mark TEFLON: the sole of the boot rests on the plate once the binding has been closed.

Such know devices, however, have the disadvantage of not dynamically facilitating in any way the disengagement of the boot from the binding; for example the presence of mud on the surface of the boot heel can defect the characteristic of the material from which the plate is made.

As a partial solution to this disadvantage, plates have been provided which can slide along an axis which is essentially transverse to the ski, by means of adapted ball bearings which interact with the plates and which reduce, during release, the friction between the sole of the boot and the ski; the movement for the release of the boot from the binding is thus facilitated.

Even this solution, however, is not optimum, since during release there is no reduction in the friction between the sole of the boot and the plate.

As a partial solution to these disadvantages, devices are known wherein the plates are connected to the tip element so that a rotation of the tip element leads to a rotation of the plate as well, so as to facilitate the release of the boot from the binding.

The disadvantage of the solution consists of the fact that the movement of the plate activated directly by the movement of the tip element; thus, each movement of the tip element is univocally matched by a movement of the plate, regardless of the value of the friction occurring between the sole of the boot and the surface of said plate.

This is a considerable limitation, since even a slight movement of the tip element, due for example to the stresses imparted thereto by the ski while skiing, can induce a release of the boot which is neither necessary nor desired.

A slight rotation of the tip element in fact imposes a rotation to the plate and thus arranges the boot off-axis with respect to the ski, and consequently also with respect to the binding, thereby facilitating its release.

SUMMARY OF THE INVENTION

The aim of the present invention is therefore to eliminate the disadvantages described above in know types by providing a device which allow to reduce the friction between the sole of the boot and the surface of the ski during safety release from the binding.

Within the scope of the above aim, another important object is to provide a device which allows to activate that safety release of the binding in case of actual need, without such safety release occurring upon small rotations or movements of the binding.

Another object is to provide a device which is reliable and safe in use.

Not least object is to provide a device which associates with the preceding characteristics that of being structurally simple and of having modest costs, in which the device is made with conventional know machinery.

This aim, these objects and others which will become apparent hereinafter are achieved by an antifriction device particularly for bindings including a first body which is fixed to a ski, a second body which is slidingly supported by the first body in a direction parallel to the longitudinal axis of the ski, a tab element which is connected to the second body so as to slide therewith, and a plate, upon which a ski boot sole rests during use, which is freely pivoted to the tab about a vertical axis perpendicular to the ski.

BRIEF DESCRIPTION OF THE DRAWINGS

Further characteristics and advantages of the invention will become apparent from the detailed description of a particular embodiment thereof, illustrated only by way of non-limitative example in the accompanying drawings, wherein.

DESCRIPTION OF THE PREFERRED EMBODIMENTS

Figure 2:
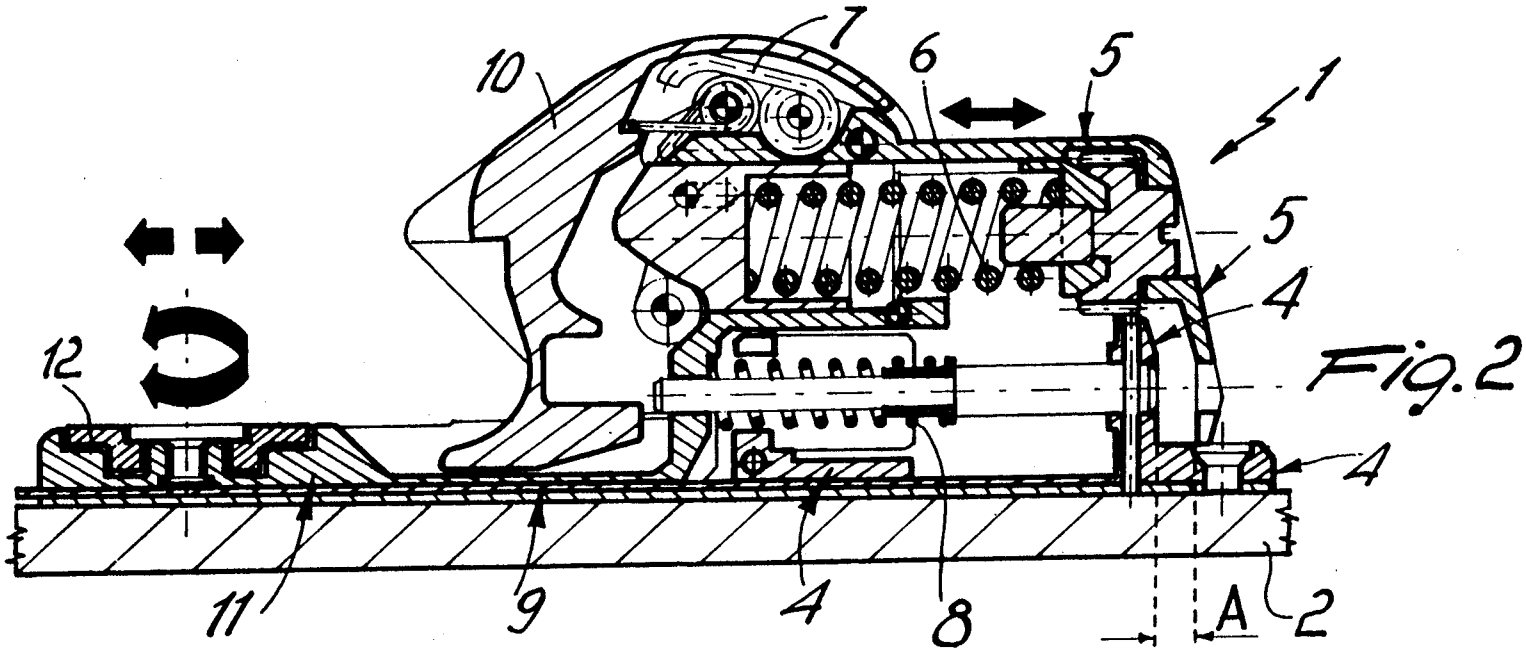
FIG. 2 is a sectional view of the antifriction device, taken along a median plane which is longitudinal with respect to the binding.
Figure 1:
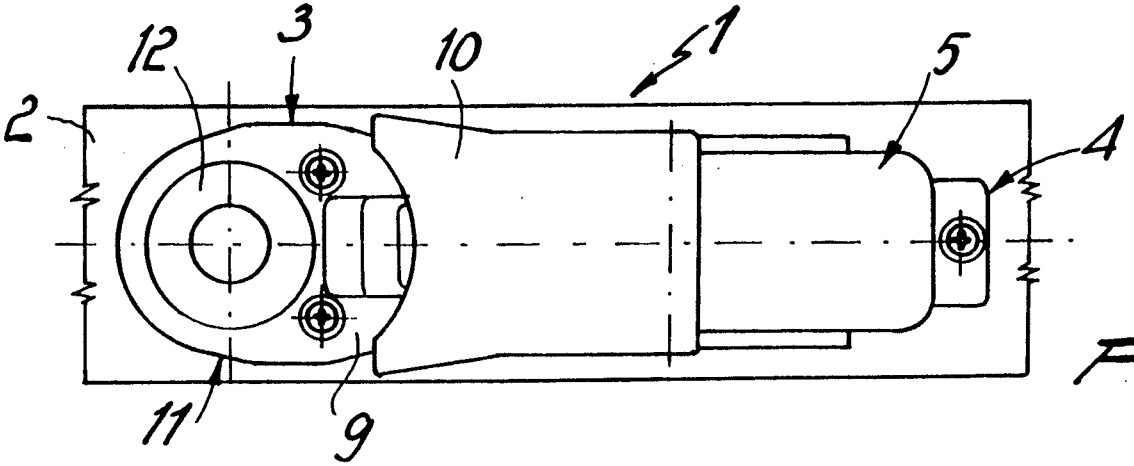
FIG. 1 is a top view of the device applied to a heel element of a ski binding.

With reference to the above figures, the reference numeral 1 indicates a heel element of a binding for a ski 2 with which the antifriction device, indicated by the numeral 3, is associated.

The heel element 1 is constituted by a first body 4 which is fixed to the ski 2 or is associable therewith and with which a second body 5 is internally slidingly associated with the possibility of sliding along an axis which is longitudinal to the ski 2.

The mutual movement of the first and second bodies in which the near-maximum extent whereof is indicated in FIG. 2 by the letter A, is allowed by adapted elastic means, including in particular the springs 6, 7 and 8 which are part respectively of means suitable for allowing the automatic reset of the binding in case of safety release and of means for compensating the deflection of the ski during skiing, to achieve an elastic recovery which allows to avoid an unnecessary release of the boot.

The antifriction device 3 comprises at least one tab 9 which, in the particular embodiment illustrated, is rigidly associated with the second body 5 and protruded therefrom toward the tip of the ski 2 along a median longitudinal axis.

Tab 9 is arranged adjacent to the ski 2, in order to lie below the jaw 10 of the heel element and below the sole of the boot.

The length of the tab 9 is therefore such as to protrude beyond the jaw 10, and at least one plate 12, which preferably has a circular plan shape, is freely pivoted, along an axis which is perpendicular to the ski 2, to the terminal end 11 of the tab.

In the use of the ski binding, following a safety release in which the pressure exerted by the heel of the boot on the jaw 10 of the heel element ceases, the second body 5 moves toward the tip of the ski due to the spring 8, allowing the opening of the jaw 10 and thus the automatic reset of the heel element by virtue of the adapted means provided therein.

The presence of the tab 9 and of the plate 12 allows to reduce the friction between the heel of the boot and the surface of the ski during the safety release; the tab 9 can in fact perform a translatory motion, along an axis which is longitudinal to the ski 2, which is activated by the movement of the second body 5, whereas the plate 12 can perform a rotary motion with respect to the tab 9 about an axis which is vertical to the ski 2.

This rotation occurs by virtue of the friction which exists between the plate 12 and the sole of the boot when said boot is subjected to a lateral release in extreme conditions.

It has thus been observed that the invention has achieved the intended aim and objects, since a device has been provided which allows to reduce the friction between the sole of the boot and the surface of the ski during a safety release from the binding.

An advantage offered by this invention consists of the fact that during the release of the boot the sole thereof rotates substantially with respect to the tibial axis of the leg and, in some cases, moves longitudinally with respect to the ski: therefore, with respect to the prior art, in which a possible plate can be freely pivoted directly at the ski, the heel has agreeable rotation radius with respect to that of the plate, such radius deriving from the simple rotary motion or from the compound rotary and translatory motion.

In the illustrated solution, the simultaneous translatory motion of the tab 9 thus allows to compensate the difference between the radius of the rotation of the heel of the boot and that of the plate 12, thus allowing to follow the various movements of the sole without inducing relative motions between the sole and the plate 12 which lead to passive forces, i.e. to friction.

The device furthermore allows to activate the safety release of the binding in case of actual need, without the safety release being imparted upon small rotations of the tip element of the ski binding.

The device furthermore has modest manufacturing costs and is structurally simple.

The tab 9 may naturally be rigidly associated or coupled or applied on the second body 5, all this being done using known connection means.

The dimensions and the material which constitute the individual components of the device may naturally also be the most appropriate according to the specific requirements.

We claim:

1. A ski binding:

a first body which is connectable to a ski in a fixed position;

a second body which is slidably supported by said first body, said second body being slidable with respect to said first body in a direction parallel to a longitudinal axis of the ski;

means for biasing said second body into a forward position thereof with respect to said first body;

means for releasbly holding down a ski boot sole portion, said means for releasably holding down being connected to said second body;

a tab element which is rigidly connected to said second body and which extends forwardly therefrom and above which a ski boot sole lower surface is arrangeable, thereby said tab element being slidable rigidly with said second body in said direction parallel to the longitudinal axis of the ski; and a plate element for engaging the ski boot sole lower surface which is pivotally mounted to said tab element about a vertical axis which is substantially perpendicular to the longitudinal axis of the ski.

2. A ski binding comprising:

a first body which is connectable to a ski in a fixed position;

a second body which is slidably supported by said first body, said second body being slidable with respect to said first body in a direction parallel to a longitudinal axis of the ski;

means for biasing said second body into a forward position thereof with respect to said first body;

means for releasbly holding down a ski boot sole portion, said means for releasbly holding down being connected to said second body;

a tab element which is rigidly connected to said second body and which extends forwardly therefrom and above which a ski boot sole lower surface is arrangeable, thereby said tab element being slidable rigidly with said second body in said direction parallel to the longitudinal axis of the ski; and a plate element for engaging the ski boot sole lower surface which is pivotally mounted to said tab element abut a vertical axis which is substantially perpendicular to the longitudinal axis of the ski, wherein said plate element constituted by a circular plate element.

3. A ski binding comprising:

a first body which is connectable to a ski in a fixed position;

a second body which is slidably supported by said first body, said second body being slidable with respect to said first body in a direction parallel to a longitudinal axis of the ski;

means for biasing said second body into a forward position thereof with respect to said first body;

means for releasbly holding down a ski boot sole portion, said means for releasbly holding down being connected to said second body;

a tab element which is rigidly connected to said second body and which extends forwardly therefrom and above which a ski boot sole lower surface is arrangeable, thereby said tab element being slidable rigidly with said second body in said direction parallel to the longitudinal axis of the ski; and a plate element for engaging the ski boot sole lower surface which is pivotally mounted to said tab element abut a vertical axis which is substantially perpendicular to the longitudinal axis of the ski, wherein said first body and said second body form part of a heel holding element and wherein said means for releasbly holding down a ski boot sole portion comprise a heel engaging jaw rotatably pivoted to said second body about a horizontal transverse axis.

* * * * *